United States Patent [19]

Cassidy

[11] Patent Number: 4,569,475

[45] Date of Patent: Feb. 11, 1986

[54] FLIP TOP CARTON

[75] Inventor: Benjamin J. Cassidy, Waldwick, N.J.

[73] Assignee: International Paper Company, New York, N.Y.

[21] Appl. No.: 659,479

[22] Filed: Oct. 10, 1984

[51] Int. Cl.[4] ..... B65D 5/54

[52] U.S. Cl. ..... 229/44 CB; 206/624

[58] Field of Search ..... 229/44 CB; 206/624

[56] References Cited

U.S. PATENT DOCUMENTS

| | | | |
|---|---|---|---|
| 2,796,212 | 6/1957 | Graybill | 229/44 CB |
| 2,946,499 | 7/1960 | Creelman | 229/44 CB |
| 2,963,214 | 12/1960 | Leone et al. | 229/44 CB |
| 3,078,030 | 2/1963 | Gorton | 229/44 |
| 3,090,540 | 5/1963 | Arneson | 229/44 |
| 3,438,564 | 4/1969 | Moreton | 229/16 |
| 3,910,487 | 10/1975 | Jaeschke | 229/51 TC |
| 4,127,229 | 11/1978 | Roccaforte | 229/44 CB |
| 4,314,643 | 2/1982 | Forbes | 206/626 |
| 4,325,482 | 4/1982 | Fesser | 206/625 |
| 4,447,003 | 5/1984 | Gray | 229/44 CB |

FOREIGN PATENT DOCUMENTS

| | | | |
|---|---|---|---|
| 253340 | 7/1964 | Australia | 229/44 CB |
| 794700 | 9/1968 | Canada | 206/624 |

*Primary Examiner*—Stephen P. Garbe

*Attorney, Agent, or Firm*—Richard J. Ancel

[57] ABSTRACT

A container in the shape of a rectangular parallelepiped. The front and side walls are provided with severable perforated lines. Upon rupture of the severable lines, a hinged, box-like lid is formed which is reclosable. The container front wall is associated with upstanding L-shaped posts at its upper edge. One surface of each L-shaped post frictionally fits into a respective gap space within the box-like lid, each gap space defined by parallel lid guide flaps carried by the sides of the box-like lid. The container is loaded from one end, with, for example, a plurality of crayons, and then closed to define a package. The container is formed from a single sheet of paperboard.

10 Claims, 7 Drawing Figures

FIG. 2
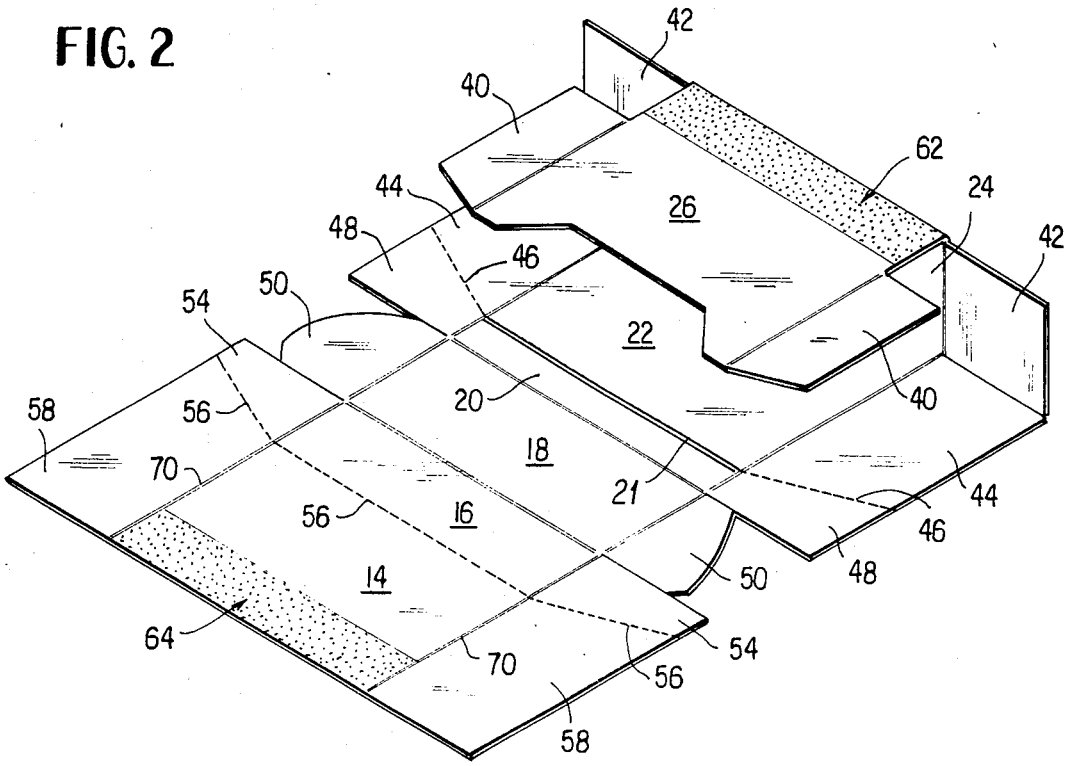
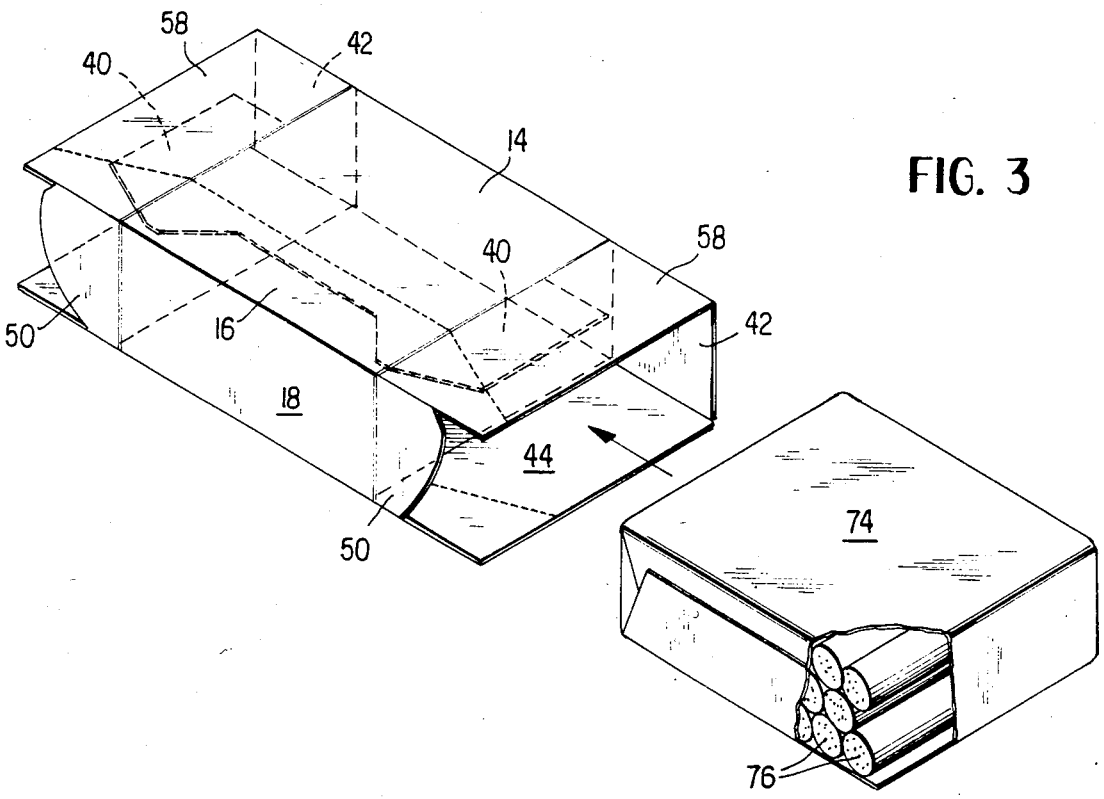
FIG. 3

FLIP TOP CARTON

BACKGROUND OF THE INVENTION

This invention relates to containers and more particularly to a container adapted to hold cigarettes, plastic adhesive strips (i.e. Band-Aids®), crayons, or other rod-like elements.

SUMMARY OF THE INVENTION

The container is in the general form of a rectangular parallelepiped and is formed by suitably scoring, cutting, bending, and folding a one-piece blank, the blank being formed of a sheet of paperboard or other generally stiff, resilient and foldable material.

After filling and closing the container to form a package, opening is carried out by breaking certain several perforated lines to thereby define a main body portion and a box-like reclosable lid carried by and hinged to the rear wall of the main body portion. A post is positioned at each end of the upper edge of the front wall of the main body, the posts formed by integral, folded panel portions. The box-like lid carries lid guide panels within it for the purpose of guiding the lid to its desired closed position. The lid guide panels also cooperate with the posts to frictionally maintain the box-like lid in its closed position. The contents of the container are loaded from the side of the container prior to final closure at the packager's production facility, where the flat blanks of this invention are folded, filled and closed to form the complete package. Side loading is an easier method of loading a product in those cases wherein the product is to be dispensed or removed from the container while the product is in a vertical position.

The full nature of the invention will be understood from the accompanying drawings and the following description and claims. It should be understood, however, references in the following description to terms such as left, right, base, front, rear and side wall members or panels are for convenience of description, and such terms are not intended to be used in a limiting sense.

BRIEF DESCRIPTION OF THE DRAWINGS

FIG. 2 is a perspective view of the blank of FIG. 1 partially folded.

FIG. 3 is a perspective view, similar to FIG. 2, showing a subsequent folding stage.

DETAILED DESCRIPTION OF THE INVENTION

Figure 1:
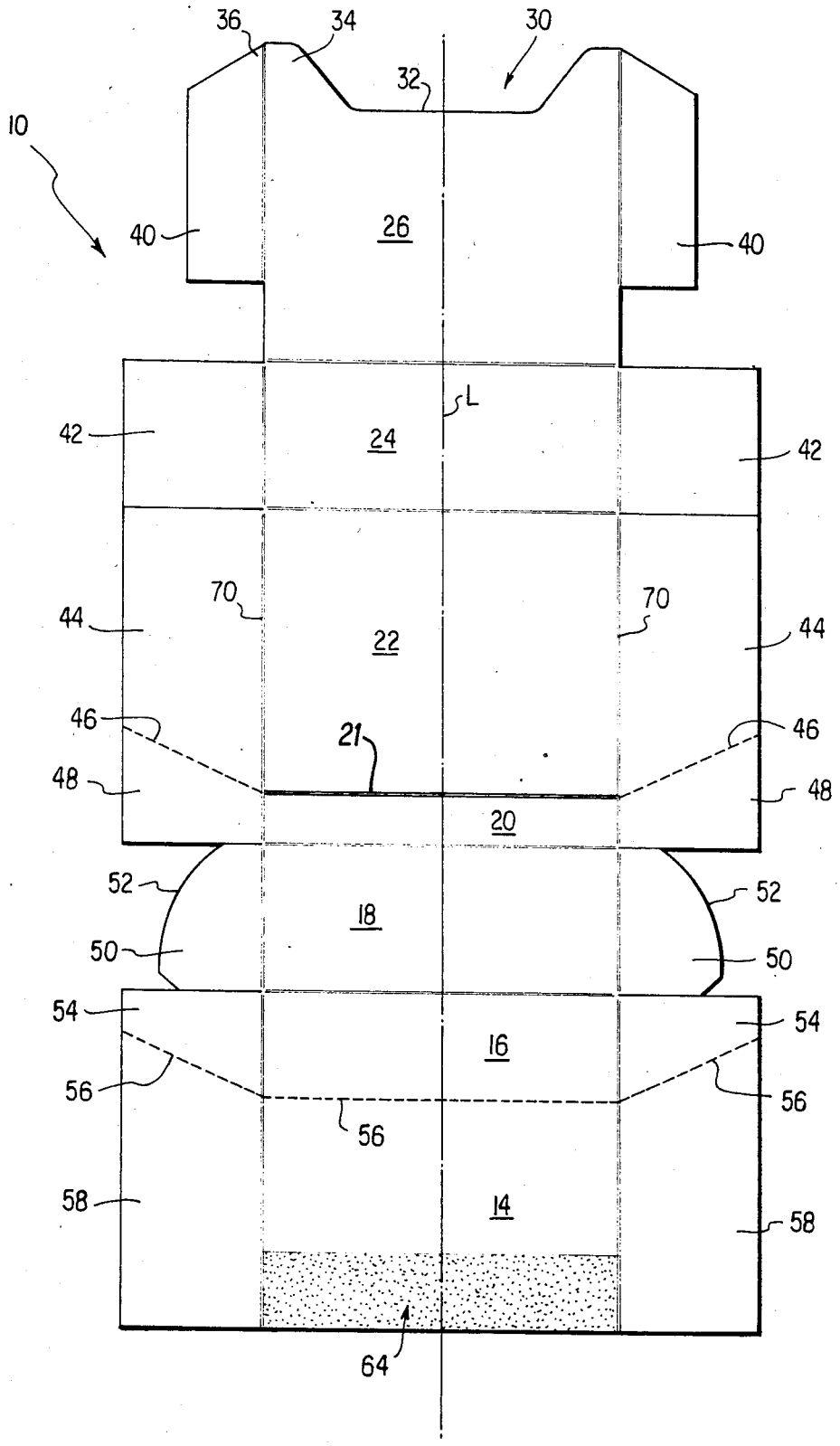
FIG. 1 is a plan view of a single or one-piece blank of paperboard, cardboard or similar material which is suitably cut and provided with hinge lines to form the container/package of this invention when folded, filled and glued.

Referring now to FIG. 1 of the drawings, the numeral 10 denotes generally the blank from which the container of this invention is formed. The blank is formed of cardboard, paperboard, or other stiff, resilient and foldable material. The axis L denotes the central longitudinal axis of the blank, and the reader will observe that the blank exhibits mirror symmetry about this axis, i.e., the configuration of the right hand portion of the blank, if folded about axis L, would match the configuration of the left portion of the blank. In the following description of the blank, as well as of the completed container, the term upper will refer to the upper portions of the blank or any part thereof, while the term lower will refer to the lower portions of the blank or any part thereof. Similarly, the term inner will refer to portions towards axis L, while the term outer will refer to portions more remote from axis L.

In FIG. 1, the dashed lines indicate fold or hinge axes, while the solid lines indicate cut lines extending completely through the blank. Further, the adjectives front, bottom, etc. will also refer to, in describing FIG. 1, those front, bottom, etc. portions of the container defined by the blank after its folding.

The numeral 14 denotes the front panel, the upper portion of which is denoted by the numeral 16 with severable perforated line 56 running between them. Top box-like lid panel 18 is hingedly connected to the top of portion 16. Rear box-like lid panel 20 is hingedly connected to panel 18. Rear container panel 22 includes a transverse hinge line 21, with the upper edge of panel 22 hingedly connected to bottom panel 24. Post-forming panel 26 is hingedly connected to the top of panel 24. The upper edge of post-forming panel 26 is centrally recessed as denoted by the numeral 30, the central recess including an upper edge portion 32. The numeral 34 denotes those portions of panel 26 which are above edge 32. The numeral 36 denotes the upper portion of post-forming flaps 40, each of which is hinged to a respective side of panel 26. The numeral 42 denotes bottom side flaps hingedly connected to the sides of bottom panel 24, flaps 42 adapted to reinforce the sides of the container. The numeral 44 denotes side flaps 44, these flaps being hingedly connected to the sides of panel 22. The numeral 46 denotes a severable, perforated line whose inner end commences at an outer end of hinge line 21 and extends to the edge of flap 44. The numeral 48 denotes a flap portion integral with flap 44 and which is also hingedly connected to the ends of panel 20. The numeral 50 denotes 1 friction flap hingedly connected to respective edges of panel 18, the outermost or free edge of flap 50 being curved as denoted by the numeral 52. Flap 54 is hinged to the ends of panel portion 16, with numeral 55 denoting a severable perforated line running from the free edge of flap 54 to an edge of front panel 14. The numeral 58 denotes a side flap hingedly connected to the ends of panel 14. Flaps 58 and 54 are termed first side wall flaps, while flaps 44 and 48 are termed second side flaps.

The numeral 62 denotes an adhesive pattern at the bottom of panel 26, and the numeral 64 denotes a similar adhesive pattern at the bottom of panel 14. As will later be apparent from the mode of folding the blank of FIG. 1 to form the container of this invention, both adhesive patterns 62 and 64 are not necessary, only one being required for assembly. It will be further understood that adhesive patterns 62 and 64 lie on opposite surfaces of the blank of FIG. 1, as will be evident from the latter description, adhesive patterns 62 and 64 may be omitted, with corresponding patterns being simply deposited on the blank during the folding operation.

The numeral 70 denotes either one of two fold lines or axes running parallel to axis L about which the flaps 40, 42, 44, 48, 50, 54 and 58 hinge to their respective panels.

Referring now to FIGS. 2 and 3 of the drawings, the manner of initially forming the container of this invention is illustrated. Panels 24 and 26 are folded as indicated, with panel 26 overlying and being parallel to panel 22. As the next step, panels 18 and 14 are folded, about the hinge line joining panels 20 and 18, so that panel 18 is parallel to bottom panel 24. Next, panel 14 is folded about the hinge line connecting panels 18 and panel portion 16, so that panel 14 overlies panel 26. This is illustrated at FIG. 3 of the drawings. Adhesive pattern 62 or pattern 64 is employed to secure panels 14 and 26 together.

The structure shown at FIG. 3 of the drawings is commonly referred to in this art as a tube. Next, a prewrapped packet 74 of elongated cylindrical elements 76, such as crayons, is inserted by pushing it into one of the open ends of the tube of FIG. 3.

The end closure flaps of the tube are now folded in the following sequence. Flaps 42 and 50 are folded inwardly. Next, flap 44 is folded inwardly, so as to overlie and be in parallelism with flaps 42 and 50. Lastly, flap 58 is folded so as to overlie and be in parallelism with flap 44. The reader will observe that the folding of flaps 58 causes a corresponding folding of flaps 40. The end closure flaps are held closed by any conventional adhesive applications. The container/-package is now complete, as indicated at FIG. 4, and is ready for shipment and distribution.

Figure 4:
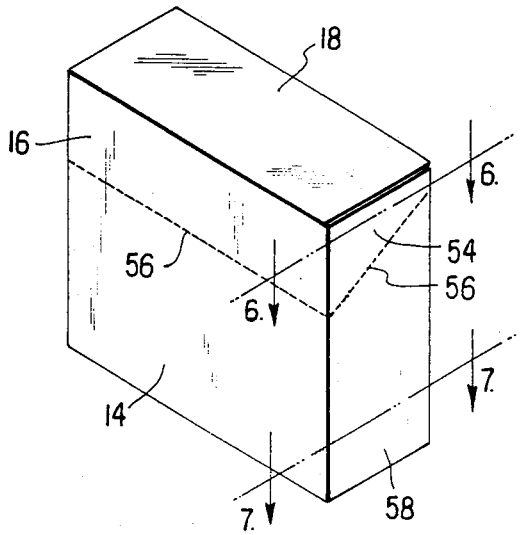
FIG. 4 is a view illustrating the completed container.
Figure 5:
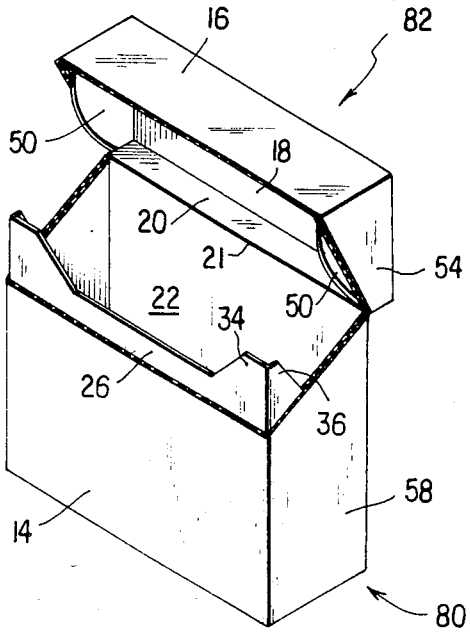
FIG. 5 is a view of the container when opened to thereby form a hinged and reclosable box-like lid.

To open the container/package of this invention, the user grasps the lower portion of the container and also the side portions above the severable perforated lines 56, see FIG. 4. A pulling action results in the breakage or severance of the lines, with the result being illustrated at FIG. 5 of the drawings. The lower portion of the opened container of FIG. 5 is denoted generally by the numeral 80, while the upper portion is denoted by the numeral 82. Thus, the numeral 82 denotes a generally box-like lid which is integrally hinged along hinge line 21 to the upper edge of rear panel 22. Friction flaps 50 are the innermost flaps within lid 82.

Figure 6:
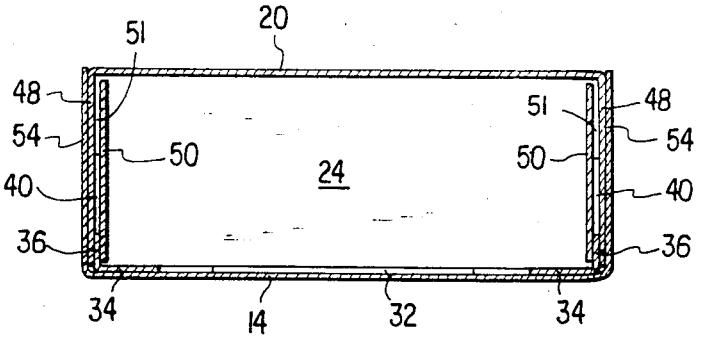
FIG. 6 is a view taken along section 6—6 of FIG. 4.
Figure 7:
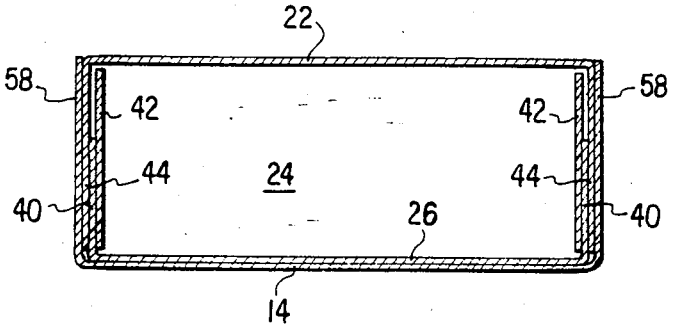
FIG. 7 is a view taken along section 7—7 of FIG. 4.

As may be seen now by reference to FIGS. 6 and 7 of the drawings, the upper portion 36 of post-forming flap 40 is sandwiched, in the closed condition of the container, between a respective friction flap 50 and a respective innermost lid side flap 48. The space between a friction flap 50 and its corresponding side flap 48 is termed a gap space 51. Flap 54 defines outermost side flap of box-like lid 82. Edge 32 of central recess 30 extends above the upper edge of front panel 14. Thus, an L-shaped post 34, 36 is formed at each upper end of front panel 14. The front wall of the container of FIG. 5 may be considered as defined by two parallel sheets, an outermost sheet 14 and an innermost sheet 26.

Assuming a typical use for the container of this invention as a package filled with crayons, after one of the crayons is removed, the lid 82 can be reclosed, with post-forming portions 36 being sandwiched between respective friction flaps 50 and flaps 48. In order to facilitate the movement of the lower front portion of lid 82 past the upstanding post portions 36, the free edges of friction flaps 50 are curved as denoted by the numeral 52.

Post forming panel 26, with its L-shaped end posts 34, 36, adds to the rigidity of the front wall of the container, while the posts themselves cooperate with the lid in a manner above described. Another advantage enjoyed by the practice of this invention is the capability to accept end loading of the container contents, as illustrated at FIG. 3.

In the claims, the terms upper, lower, and side will refer to the upper, lower and side portions of the container and/or blank of this invention as shown at FIGS. 1, 4 and 5.

Generally speaking, the present invention is directed to a container of rectangular parallelepiped shape formed from a single blank of stiff, foldable and resilient material, such as paperboard. The container has front, rear, top, bottom and side walls, and severable perforated lines in the side walls extending from the upper portion of the rear wall to the front wall. The front wall is defined by two partially coextensive panels, the outermost panel having a severable perforated line extending thereacross and whose ends meet, respectively, one end of a severable perforated line on each side wall, a lid hinge line on the rear wall whose termini meet, respectively, the other end of one of the severable perforated lines on each side wall, whereby the portion of the container above the perforated lines and above the lid hinge line forms a box-like lid which can be hinged about the lid hinge line upon breaking the severable perforated lines. The innermost panel of the front wall includes post flap at each side thereof parallel to a respective side wall of the container and whose upper edge extends above the severable perforated lines on the container side walls. The top wall of the box-like lid has at each end thereof a downwardly extending friction flap and a gap space between each friction flap and its respective box-like lid side wall. Each post flap is sandwiched in its respective gap space, whereby when the box-like lid is formed it can be reopened and reclosed by being hinged along the lid hinge line, with the post flaps frictionally sandwiched in the gap spaces upon reclosing to thereby assist in properly aligning the box-like lid relative to the remainder of the container upon reclosure of the box-like lid and also to assist in maintaining the box-like lid in the reclosed position by virtue of such frictional engagement.

Although the invention has been described above by reference to a preferred embodiment, it will be appreciated that other carton constructions may be devised, which are, nevertheless, within the scope and spirit of the invention and are defined by the claims appended thereto.

What is claimed is:

1. A one piece blank formed of stiff, resilient and foldable sheet material, such as paperboard, the blank being provided with a plurality of fold lines, cut lines, and severable perforated lines to thereby form a container of rectangular parallelepiped shape having a hinged lid, the lid when closed forming a portion of the container, the blank being of generally rectangular form, the blank having a central longitudinal axis, the blank exhibiting mirror symmetry with respect to its central longitudinal axis, the blank having an upper end and a lower end, the blank including, in series from its lower end to its upper end, a front wall panel, a front lid panel portion, a severable perforated line between said joining said panel and panel portion, a top lid panel hinged to said front lid panel portion, a rear lid panel hinged to said top lid panel, a rear wall panel hinged to said rear lid panel, a bottom panel hinged to said rear wall panel, a post-forming panel having an upper free edge and hinged to said bottom panel, the recited hinge connections and the severable perforated line being at right angles to the longitudinal axis of the blank, a first side wall flap hinged to each side of the front wall panel, a first side wall flap hinged to each side of the front lid panel portion, each front wall first side wall flap joined by a severable perforated line to a respective first lid side wall flap, a lid friction flap having a free end hinged to each side of the top lid panel, a second lid side wall flap hinged to each side of the rear lid panel, a second side wall flap hinged to each side of the rear wall panel, each second lid side wall flap connected to a respective second side wall flap by a severable perforated line, a post forming flap hinged to each side of the post-forming panel, the hinge connections between the flaps and the panels being parallel to the longitudinal axis of the blank, each lid friction flap being separate from its adjacent first and second side wall flaps, whereby the blank can be folded about the hinge connections at right angles to the central longitudinal axis to thereby form a tube suitable for loading of container contents and whereby the flaps can be folded about their hinge connections parallel to the central longitudinal axis of the blank to close the container, and whereby the closed container can be opened by pulling on the lid side wall flaps to sever the severable perforated lines and thereby form a hinged and reclosable box-like lid.

2. The blank of claim 1 wherein the free edge of each friction flap is curved.

3. The blank of claim 1 including side wall reinforcing flaps hinged to each side of the bottom panel.

4. The blank of claim 1 wherein the upper free edge of the post-forming panel is centrally recessed.

5. The one piece blank of claim 1 wherein the post forming flaps are narrower than the side wall flaps.

6. A container of rectangular parallelepiped shape formed from a single sheet of stiff, foldable and resilinet material, such as paperboard, the container having front, rear, top, bottom and side walls, severable perforated lines in the side walls extending from the upper portion the rear wall to the front wall, the front wall defined by two partially coextensive panels of said sheet material, one of said front wall panels being outermost and the other of said front wall panels being innermost and located interiorly of said outermost panel, the outermost panel of which has a severable perforated line extending thereacross and whose ends meet, respectively, one end of a severable perforated line on each side wall, a lid hinge line on the rear wall whose termini meet, respectively, the other end of one of said severable perforated lines on each side wall, whereby the portion of the container above said perforated lines and above said lid hinge line forms a box-like lid which can be hinged about said lid hinge line upon breaking the said severable perforated lines, the innermost panel of the front wall including a post flap at each side thereof parallel to a respective side wall of the container and whose upper edge extends above the severable perforated lines on the container side walls, the top wall of the box-like lid having at each end thereof a downwardly extending friction flap having a free end, a gap space between each friction flap and its respective box-like lid side wall, each post flap being sandwiched in its respective gap space, whereby when the box-like lid is formed it can be reopened and reclosed by being hinged along said lid hinge line, with the post flaps frictionally sandwiched in the gap spaces upon reclosing to thereby assist in properly aligning the box-like lid relative to the remainder of the container upon reclosure of the box-like lid and also to assist in maintaining the box-like lid in the reclosed position by virtue of said frictional engagement.

7. The container of claim 6 wherein the free end of each friction flap is curved, to thereby facilitate entry of each post flap into its respective gap space.

8. The container of claim 6 wherein the upper edge of the inner panel of the front wall extends above the severable perforated line on the outermost panel of the front wall.

9. The container of claim 8 wherein the upper edge of the innermost panel of the front wall is centrally recessed, to thereby define generally L-shaped posts extending above the perforated lines.

10. The container of claim 6 wherein the post flaps are narrrower than the side walls.

* * * * *